US010519807B2

(12) United States Patent
Shoemaker et al.

(10) Patent No.: US 10,519,807 B2
(45) Date of Patent: Dec. 31, 2019

(54) SEAL SEGMENT RETENTION RING WITH CHORDAL SEAL FEATURE

(71) Applicants: Rolls-Royce Corporation, Indianapolis, IN (US); Rolls-Royce High Temperature Composites, Inc., Cypress, CA (US); Rolls-Royce North American Technologies, Inc., Indianapolis, IN (US)

(72) Inventors: Brian J. Shoemaker, Indianapolis, IN (US); Joseph P. Lamusga, Long Beach, CA (US); Ted J. Freeman, Danville, IN (US)

(73) Assignees: Rolls-Royce Corporation, Indianapolis, IN (US); Rolls-Royce North American Technologies Inc., Indianapolis, IN (US); Rolls-Royce High Temperature Composites Inc., Cypress, CA (US)

( * ) Notice: Subject to any disclaimer, the term of this patent is extended or adjusted under 35 U.S.C. 154(b) by 288 days.

(21) Appl. No.: 15/491,601

(22) Filed: Apr. 19, 2017

(65) Prior Publication Data

US 2018/0306063 A1 Oct. 25, 2018

(51) Int. Cl.

| | |
|---|---|
| ***F01D 25/24*** | (2006.01) |
| ***F01D 11/08*** | (2006.01) |
| ***F01D 5/02*** | (2006.01) |
| ***F01D 9/04*** | (2006.01) |
| ***F01D 11/00*** | (2006.01) |

(52) U.S. Cl.

CPC ..... *F01D 25/246* (2013.01); *F01D 5/02* (2013.01); *F01D 9/04* (2013.01); *F01D 11/005* (2013.01); *F01D 11/08* (2013.01); *F05D 2220/30* (2013.01); *F05D 2230/642* (2013.01); *F05D 2240/11* (2013.01); *F05D 2240/55* (2013.01); *F05D 2250/131* (2013.01); *F05D 2250/75* (2013.01); *F05D 2260/30* (2013.01); *F05D 2300/6033* (2013.01)

(58) Field of Classification Search

CPC . F01D 25/246; F01D 5/02; F01D 9/04; F01D 9/023; F01D 11/88; F01D 11/005; F05D 2260/30; F05D 2220/30; F16J 15/006; F16J 15/3288

See application file for complete search history.

(56) References Cited

U.S. PATENT DOCUMENTS 5,066,025 A * 11/1991 Hanrahan ..... F16J 15/3288 277/355
5,074,748 A * 12/1991 Hagle ..... F01D 9/023 277/355
6,537,023 B1 3/2003 Aksit et al.
6,568,903 B1 5/2003 Aksit et al.
(Continued)

*Primary Examiner* — George C Jin
(74) *Attorney, Agent, or Firm* — Barnes & Thornburg LLP

(57) ABSTRACT

Turbine assemblies for a turbine of a gas turbine engine are disclosed herein. The turbine assemblies include a carrier and a blade track. The blade track extends around blades of a turbine wheel assembly to block gasses passed along a gas path from moving over the blades without causing the blades to rotate during operation of the turbine assembly. The blade track includes a plurality of blade track segments arranged circumferentially adjacent to one another about a central axis to form a ring. A retention ring engages both the carrier and the blade track segments to facilitate coupling and sealing.

18 Claims, 3 Drawing Sheets

(56) References Cited

U.S. PATENT DOCUMENTS

| | | | | |
|---|---|---|---|---|
| 6,572,331 | B1 | 6/2003 | Mohammed-Fakir et al. | |
| 6,595,745 | B1 | 7/2003 | Mohammed-Fakir et al. | |
| 6,599,089 | B2 | 7/2003 | Aksit et al. | |
| 6,609,885 | B2 | 8/2003 | Mohammed-Fakir et al. | |
| 6,637,751 | B2 * | 10/2003 | Aksit | F01D 9/041 277/416 |
| 6,637,752 | B2 | 10/2003 | Aksit et al. | |
| 6,637,753 | B2 | 10/2003 | Mohammed-Fakir et al. | |
| 6,641,144 | B2 | 11/2003 | Mohammed-Fakir et al. | |
| 6,719,295 | B2 | 4/2004 | Mohammed-Fakir et al. | |
| 6,752,592 | B2 | 6/2004 | Mohammed-Fakir et al. | |
| 6,764,081 | B2 | 7/2004 | Mohammed-Fakir et al. | |
| 2006/0216146 | A1 * | 9/2006 | Thompson | F01D 11/08 415/213.1 |
| 2015/0204447 | A1 * | 7/2015 | Kloepfer | F01D 9/041 277/306 |
| 2016/0333712 | A1 | 11/2016 | Boeke et al. | |

* cited by examiner

SEAL SEGMENT RETENTION RING WITH CHORDAL SEAL FEATURE

FIELD OF THE DISCLOSURE

The present disclosure relates generally to gas turbine engines, and more specifically to turbine assemblies included in gas turbine engines.

BACKGROUND

Gas turbine engines typically include a compressor, a combustor, and a turbine. The compressor compresses air drawn into the engine and delivers high pressure air to the combustor. In the combustor, fuel is mixed with the high pressure air and the air/fuel mixture is ignited. Products of the combustion reaction in the combustor are directed into the turbine where work is extracted to drive various components of the gas turbine engine.

Turbines typically include alternating stages of static vane assemblies and rotatable wheel assemblies. The rotatable wheel assemblies include disks carrying blades that are coupled to the disks. When the rotatable wheel assemblies turn in response to receiving the combustion reaction products, tips of the blades move along ceramic blade tracks included in static turbine shrouds surrounding the rotating wheel assemblies. Consequently, work is extracted in the form of mechanical energy.

Components of some static turbine shrouds may be segmented and arranged to form rings around a central axis. Thermal expansion and contraction of such segmented components may differ from the thermal expansion and contraction of non-segmented components that the static turbine shroud components interface with during operation of the turbines. Managing the thermal expansion and contraction of segmented components of static turbine shrouds relative to the thermal expansion and contraction of such non-segmented components remains an area of interest.

SUMMARY

The present disclosure may comprise one or more of the following features and combinations thereof.

According to one aspect of the present disclosure, a turbine assembly may include a carrier, a blade track, and a retention ring. The carrier may be coupled to a case. The blade track may cooperate with the carrier to define a cavity configured to receive pressurized gasses. The blade track may extend around blades of a turbine wheel assembly to block gasses passed along a gas path from moving over the blades without causing the blades to rotate during operation of the turbine assembly. The blade track may include a plurality of blade track segments arranged circumferentially adjacent to one another about a central axis to form a ring. Each blade track segment may have a runner and an attachment feature coupled to the carrier. The retention ring may be coupled to the carrier and the blade track to retain the blade track segments at predetermined locations along the central axis during operation of the turbine assembly. The retention ring may include a radially-inner surface having a plurality of generally planar surface segments that cooperate to define a polygonal shape of the inner surface. Each one of the surface segments may interface with the attachment feature of one of the blade track segments such that the radially-inner surface provides a seal to resist leakage of the pressurized gasses provided to the cavity into the gas path during operation of the turbine assembly.

In some embodiments, a first point at which two circumferentially adjacent surface segments of the radially-inner surface intersect may be spaced from the central axis by a first radial distance, a second point located on one of the two circumferentially adjacent surface segments may be spaced from the central axis by a second radial distance less than the first radial distance, and a third point located on the other of the two circumferentially adjacent surface segments may be spaced from the central axis by a third radial distance less than the first radial distance. The retention ring may include an inner flange portion defining the radially-inner surface thereof that has a slightly crowned profile, and the inner flange portion may be configured to align with and engage the attachment feature of each one of the blade track segments to establish the seal during operation of the turbine assembly.

In some embodiments, the retention ring may have a full-hoop construction. The number of blade track segments of the blade track may be substantially equal to the number of surface segments of the radially-inner surface of the retention ring.

In some embodiments, the attachment feature of each blade track segment may include a forward hanger and an aft hanger located aft of the forward hanger along the central axis, and each one of the surface segments of the radially-inner surface may interface directly with the aft hanger of one of the blade track segments during operation of the turbine assembly to establish the seal. The blade track may have a ceramic matrix composite material construction, a coating may be applied to the aft hanger of each blade track segment, and each one of the surface segments may be engaged with the coating applied to the aft hanger of one of the blade track segments during operation of the turbine assembly.

In some embodiments, the retention ring may include a plurality of tabs extending outwardly from a radially-outer surface thereof opposite the radially-inner surface, and the tabs may be received by corresponding slots formed in the case such that the retention ring is installed in a predetermined orientation relative to the carrier and the blade track, constrained against rotation about the central axis, and positioned so that a center of the retention ring lies on the central axis during operation of the turbine assembly. The plurality of tabs may include three tabs. Additionally, in some embodiments, at least two of the plurality of tabs may have widths different from one another.

According to another aspect of the present disclosure, a turbine shroud may include a carrier, a blade track, and a retention ring. The carrier may be formed from metallic materials. The blade track may be coupled to the carrier and formed from ceramic matrix composite materials. The blade track may include a plurality of blade track segments. The retention ring may be coupled to the carrier and the blade track to retain the blade track segments at predetermined locations along a central axis. The retention ring may include a plurality of surface segments that interface with the blade track segments to provide a seal. The surface segments may cooperate to define a polygonal shape of at least part of the retention ring.

In some embodiments, the retention ring may have a full-hoop construction. Additionally, in some embodiments, each blade track segment may include a forward hanger and an aft hanger located aft of the forward hanger along the central axis, and each one of the surface segments may interface directly with the aft hanger of one of the blade track segments during operation of the turbine assembly to establish the seal.

In some embodiments, a first point at which two circumferentially adjacent surface segments of the retention ring intersect may be spaced from the central axis by a first radial distance, a second point located on one of the two circumferentially adjacent surface segments may be spaced from the central axis by a second radial distance less than the first radial distance, and a third point located on the other of the two circumferentially adjacent surface segments may be spaced from the central axis by a third radial distance less than the first radial distance. A portion of the retention ring may have a slightly crowned profile, and the portion may be configured to align with and engage each one of the blade track segments to establish the seal during operation of the turbine assembly.

In some embodiments, the retention ring may include a plurality of tabs extending outwardly from an outer surface thereof, and the tabs may be received by corresponding slots formed in a case such that the retention ring is installed in a predetermined orientation relative to the carrier and the blade track during operation of the turbine assembly. The tabs may be sized to be received by the slots such that a center of the retention ring lies on the central axis and the retention ring is constrained against rotation about the central axis during operation of the turbine assembly. In some embodiments, the plurality of tabs may include three tabs circumferentially spaced from one another about the central axis by about 120 degrees. In some embodiments still, the plurality of tabs may be non-equidistantly spaced from one another about the central axis. In some embodiments yet still, at least two of the plurality of tabs may have widths different from one another.

These and other features of the present disclosure will become more apparent from the following description of the illustrative embodiments.

DETAILED DESCRIPTION OF THE DRAWINGS

Figure 1:
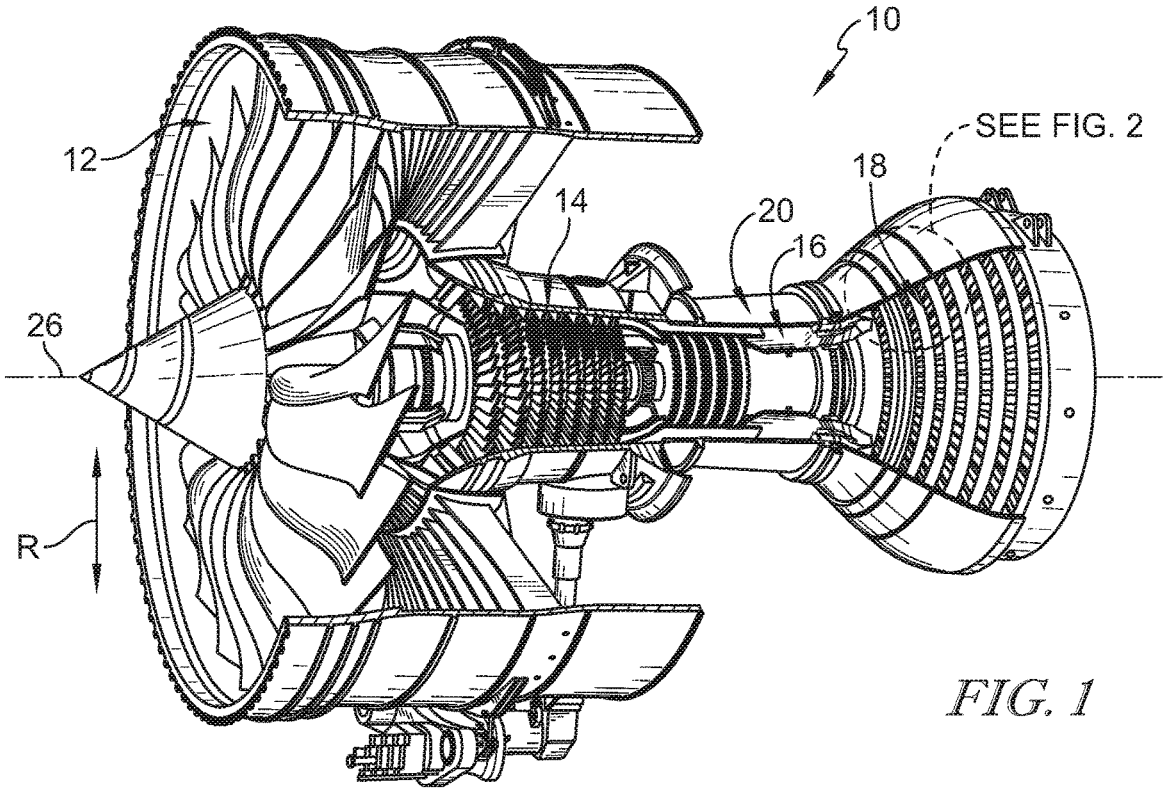
FIG. 1 is a cut-away perspective view of a gas turbine engine showing that the engine includes a turbine section.

For the purposes of promoting an understanding of the principles of the disclosure, reference will now be made to a number of illustrative embodiments illustrated in the drawings and specific language will be used to describe the same.

Referring now to FIG. 1, an illustrative gas turbine engine 10 includes a fan 12, a compressor 14, a combustor 16, and a turbine 18, each of which is surrounded and supported by a metallic case 20. The compressor 14 compresses and delivers air to the combustor 16. The combustor 16 mixes the compressed air with fuel, ignites the air/fuel mixture, and delivers the combustion products (i.e., hot, high-pressure gases) to the turbine 18. The turbine 18 converts the combustion products to mechanical energy (i.e., rotational power) that drives, among other things, the fan 12 and the compressor 14.

Figure 2:
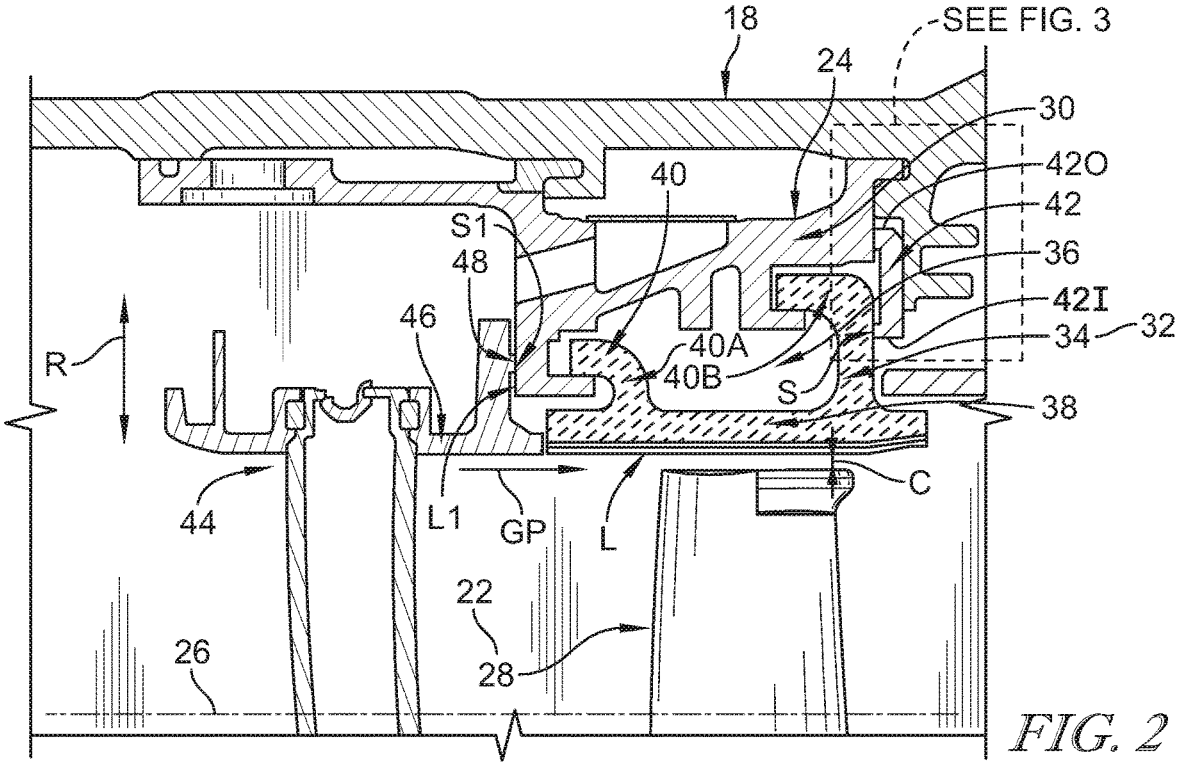
FIG. 2 is a sectional view of a portion of a turbine assembly included in the turbine section of FIG. 1 showing a rotatable wheel assembly surrounded by a static shroud that has a carrier and a blade track cooperating with the carrier to define a cavity configured to receive pressurized gasses, and showing a retention ring coupled to the carrier and the blade track that has a radially-inner surface that interfaces with the blade track such that the radially-inner surface provides a seal to resist leakage of the gasses provided to the cavity outside of the cavity.

Referring now to FIG. 2, the illustrative turbine 18 (also referred to herein as the turbine assembly 18) includes a turbine wheel assembly 22 and a turbine shroud 24 surrounding the turbine wheel assembly 22. The turbine shroud 24 resists gasses passing around the turbine wheel assembly 22 without causing the turbine wheel assembly 22 to rotate about a central axis 26. Any gasses that pass around the turbine wheel assembly 22 without pushing the assembly 22 to rotate contribute to lost performance within the gas turbine engine 10.

The illustrative turbine wheel assembly 22 includes a disk (not shown) and blades 28 extending outwardly from the disk away from the central axis 26 in a radial direction indicated by arrow R as shown in FIG. 2. The illustrative turbine shroud 24 includes a carrier 30 and a blade track 32 cooperating with the carrier 30 to define an annular, interior cavity 36. The cavity 36 is configured to receive pressurized gasses from the compressor 14 during operation of the turbine assembly 18 that resist ingress of hot gas from a gas path GP into the turbine shroud 24.

The illustrative blade track 32 extends around the blades 28 of the assembly 22 to block gasses passed along the gas path GP from moving over the blades 28 without causing the blades 28 to rotate about the axis 26 during operation of the turbine assembly 18. The illustrative blade track 32 includes arcuate blade track segments 34 that are arranged circumferentially adjacent to one another about the axis 26 to form the annular blade track 32 around the axis 26 as shown in FIGS. 1 and 2. Each of the blade track segments 34 has an arcuate runner 38 and an attachment feature 40 extending outward from the runner 38 in the radial direction. In operation, the attachment feature 40 of each segment 34 is coupled to the carrier 30. Because the carrier 30 is coupled to the metallic case 20, the carrier 30 supports the blade track 32 relative to the metallic case 20.

The illustrative turbine assembly 18 further includes a retention ring 42 coupled to the carrier 30 and the blade track 32 as shown in FIG. 2. The illustrative coupling of the retention ring 42 to the carrier 30 and the blade track 32 retains the blade track segments 34 at predetermined locations L along the central axis 26 during operation of the assembly 18. The predetermined locations L may be associated with predetermined clearances C between the blade track segments 34 and the blades 28 of the turbine wheel assembly 22 that effect desirable performance during operation of the assembly 18.

Figure 3:
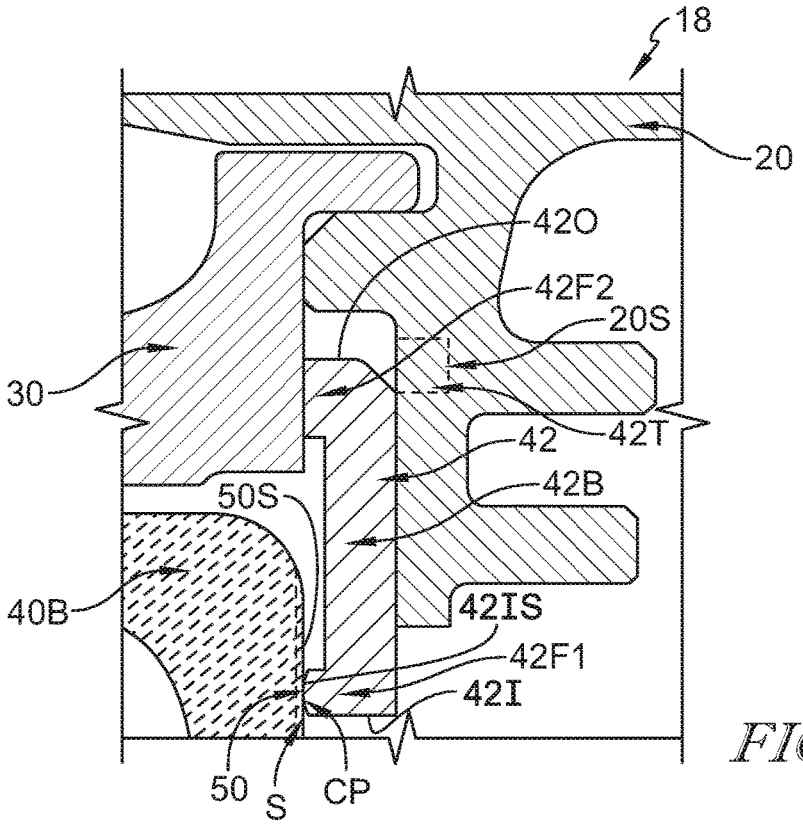
FIG. 3 is a detail view of the turbine assembly of FIG. 2 showing that surface segments of the radially-inner surface interface directly with aft hangers of the blade track to establish the seal.
Figure 4:
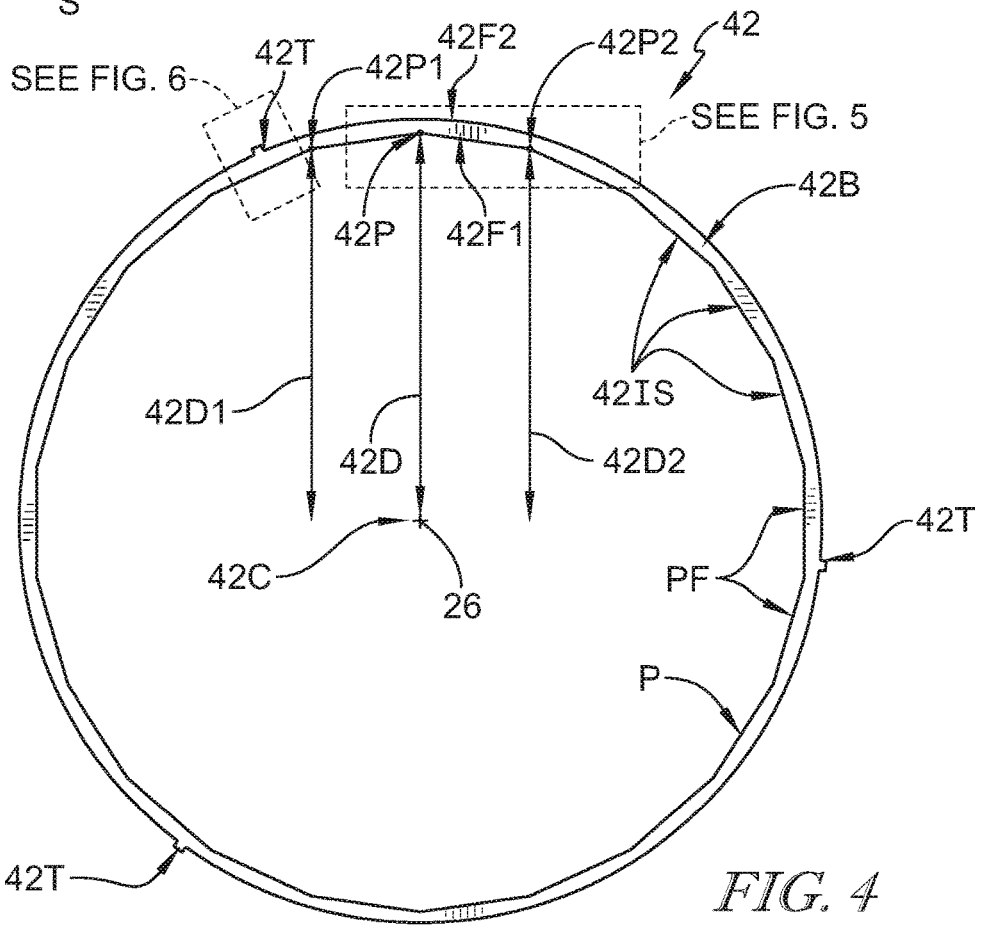
FIG. 4 is a front elevation view of the retention ring included in the turbine assembly of FIG. 2 showing that the radially-inner surface has a polygonal shape and that the retention ring includes a plurality of tabs extending outwardly from a radially-outer surface thereof that are sized to be received by corresponding slots formed in a case of the gas turbine engine.

The illustrative retention ring 42 includes a radially-inner surface 42I located inward in the radial direction relative to the central axis 26 of a radially-outer surface 42O thereof as shown in FIGS. 3 and 4. The radially-inner surface 42I has generally planar surface segments 42IS that cooperate to define a polygonal shape P of the surface 42I as shown in FIG. 4. Each one of the surface segments 42IS interfaces with the attachment feature 40 of one of the blade track segments 34 such that the radially-inner surface 42I provides a seal S, sometimes called a chordal seal, to resist leakage of the pressurized gasses provided to the cavity 36 into the gas path GP during operation of the turbine assembly 18.

The illustrative cavity 36 is configured to receive pressurized gasses discharged by the compressor 14 and passed around the combustor 16 during operation of the turbine assembly 18. The temperature of the pressurized gasses provided to the cavity 36 is less than the temperature of the gasses passed along the gas path GP. The pressurized gasses provided to the cavity 36 from the compressor 14 may therefore be used to cool the carrier 30 and the blade track 32 when those components are subjected to the gasses passed along the gas path GP. The seal S established between the blade track segments 34 and the surface segments 42IS as shown in FIG. 2 facilitates temperature management of the carrier 30 and the blade track 32. Specifically, the seal S resists leakage of the gasses from the cavity 36 into the gas path GP and also blocks migration of the gasses passed along the gas path GP into the cavity 36.

The pressurized gasses provided to the cavity 36 load the blade track 32 inward toward the central axis 26 in the radial direction and aftward along the axis 26 during operation of the turbine assembly 18 as suggested by FIG. 2. Because the illustrative retention ring 42 retains the blade track segments 34 at the predetermined locations L along the axis 26, the retention ring 42 provides a stop for the blade track 32 along the axis 26. The retention ring 42 and the carrier 30 cooperate to position the blade track 32 such that a center (not shown) of the blade track 32 lies on the axis 26.

The illustrative carrier 30 is a segmented component formed from metallic materials as shown in FIG. 2. In other embodiments, however, the carrier 30 may have a full-hoop construction and be formed from other suitable materials.

The illustrative blade track 32 is a segmented component formed from ceramic matrix composite materials as shown in FIG. 2. In other embodiments, however, the blade track 32 may have a full-hoop construction and be formed from other suitable materials.

The illustrative retention ring 42 has a full-hoop construction such that the retention ring 42 extends continuously around the central axis 26 as shown in FIG. 4. The retention ring 42 is illustratively formed from metallic materials. In other embodiments, however, the retention ring 42 may be formed from other suitable materials.

Referring again to FIG. 2, the illustrative turbine assembly 18 includes a non-rotating turbine vane assembly 44 located forward of the rotating turbine wheel assembly 22 along the central axis 26. The turbine vane assembly 44 has vanes 46 configured to interface with the carrier 30 at locations L1 along the axis 26. More specifically, seal features 48 coupled to, or otherwise included in, the vanes 46 are configured to interface with the carrier 30 at the locations L1.

The illustrative seal features 48 interface with the carrier 30 to provide a seal S1 between the vanes 46 and the carrier 30 at the locations L1 as shown in FIG. 2. In the illustrative embodiment, each of the seal features 48 is a generally planar component formed from metallic materials. In other embodiments, however, each of the seal features 48 may be formed from other suitable materials.

In some embodiments, each of the seal features 48 may have a slight degree of curvature such that each seal feature 48 may be said to have a crowned, or slightly convex, profile. In such embodiments, each of the seal features 48 may be configured to align with and engage the carrier 30 to establish the seal S1. Due at least in part to the crowned profile of each of the seal features 48, each of the features 48 may be configured to interface with the carrier 30 such that the seal S1 may be established regardless of some misalignment between each of the features 48 and the carrier 30.

The illustrative attachment feature 40 of each blade track segment 34 includes a forward hanger 40A and an aft hanger 40B as shown in FIG. 2. The aft hanger 40B is located aft of the forward hanger 40A along the central axis 26. Each one of the surface segments 42IS of the radially-inner surface 42I interfaces directly with the aft hanger 40B of one of the segments 34 during operation of the turbine assembly 18 to establish the seal S.

Referring now to FIG. 3, a coating 50 is illustratively applied to the aft hanger 40B of each blade track segment 34. In some embodiments, the coating 50 may be machined after being applied to the hanger 40B to provide a coated surface 50S having a lower roughness than an uncoated, ceramic matrix composite surface. In any case, the coating 50 may be embodied as, or otherwise include, a protective coating such as an environmental barrier coating. In other embodiments, however, the coating 50 may be embodied as, or otherwise include, another suitable coating.

Each one of the surface segments 42IS of the illustrative retention ring 42 is engaged with the coating 50 applied to the aft hanger 40B of one of the blade track segments 34 during operation of the turbine assembly as shown in FIG. 3. Engagement between each one of the surface segments 42IS and the coating 50 of one of the segments 34 establishes the seal S.

The illustrative retention ring 42 includes a body portion 42B, an inner flange portion 42F1 interconnected with the body portion 42B, and an outer flange portion 42F2 interconnected with the body portion 42B as shown in FIG. 3. Each of the inner and outer flange portions 42F1, 42F2 extend outwardly away from the body portion 42B such that the retention ring 42 has a generally C-shaped cross section. The inner flange portion 42F1 is located inward in the radial direction of the outer flange portion 42F2 relative to the central axis 26.

The inner flange portion 42F1 of the illustrative retention ring 42 defines the radially-inner surface 42I, and thus the surface segments 42IS, of the ring 42 as shown in FIGS. 3 and 4. As such, the inner flange portion 42F1 interfaces with the aft hanger 40B of each blade track segment 34 to establish the seal S during operation of the turbine assembly 18.

The illustrative inner flange portion 42F1 of the retention ring 42 has a slight degree of curvature as best seen in FIG. 3. As such, the inner flange portion 42F1 may be said to have a slightly crowned, or slightly convex, profile CP. The inner flange portion 42F1 is configured to align with and engage the aft hanger 40B of each one of the blade track segments 34 to establish the seal S. Due at least in part to the slightly crowned profile CP of the inner flange portion 42F1, each of the segments 42IS may be configured to interface with the aft hanger 40B of one of the segments 34 such that the seal S may be established regardless of some misalignment between each of the segments 42IS and the hanger 40B of one of the segments 34.

The outer flange portion 42F2 of the illustrative retention ring 42 defines the radially-outer surface 42O of the ring 42 as shown in FIGS. 3 and 4. The outer flange portion 42F2 interfaces with the carrier 30 during operation of the turbine assembly 18.

Referring now to FIG. 4, the polygonal shape P defined by the surface segments 42IS of the illustrative retention ring 42 is shown in greater detail. Each of the surface segments 42IS defines a face PF of the polygonal shape P. The surface segments 42IS are configured to interface with the aft hangers 40B of the blade track segments 34 to establish the seal S along the faces PF of the polygonal shape P.

The number of surface segments 42IS provided by the illustrative retention ring 42 is substantially equal to the number of blade track segments 34 provided by the blade track 32 as suggested by FIGS. 3 and 4. As a result, each surface segment 42IS is configured to interface with the aft hanger 40B of one of the blade track segments 34 to establish the seal S all the way around the central axis 26 during operation of the turbine assembly 18.

Figure 6:
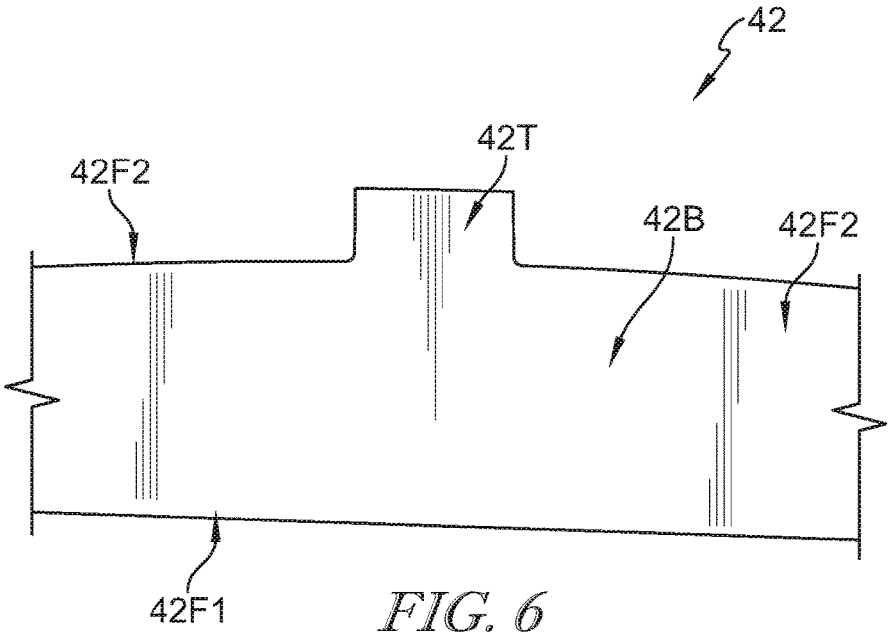
FIG. 6 is a detail view of one of the tabs of the retention ring of FIG. 4.

The illustrative retention ring 42 includes tabs 42T extending outwardly away from the radially-outer surface 42O of the ring 42 as shown in FIGS. 4 and 6. The tabs 42T are configured to be received by slots 20S formed in the case 20. More specifically, the tabs 42T are received by the slots 20S such that the retention ring 42 is installed in a predetermined orientation relative to the carrier 30 and the blade track 32 during operation of the turbine assembly 18.

Installation of the illustrative retention ring 42 in the predetermined orientation relative to the carrier 30 and the blade track 32 ensures that the surface segments 42IS interface with the aft hangers 40B of the blade track segments 34 to establish the seal S as discussed above. The tabs 42T are provided to direct installation of the ring 42 in the proper predetermined orientation during assembly of the turbine assembly 18. Additionally, the tabs 42T are provided to constrain the retention ring 42 against rotation about the central axis 26 and to center the ring 42 on the axis 26 during operation of the assembly 18.

The illustrative retention ring 42 includes three tabs 42T as shown in FIG. 4. The three tabs 42T are illustratively circumferentially spaced from one another about the central axis 26 by about 120 degrees to account for thermal expansion and contraction occurring during operation of the turbine assembly 18. In other embodiments, however, the retention ring 42 may include another suitable number of tabs 42T having another suitable circumferential spacing about the axis 26. In such embodiments, the tabs 42T may be non-equidistantly spaced from one another about the axis 26.

In the illustrative embodiment, at least two of the three tabs 42T of the retention ring 42 have widths different from one another. In some embodiments, all three of the tabs 42T may have widths different from one another. In any case, the sizes of the slots 20S formed in the case 20 differ from one another in correspondence to the different widths of the tabs 42T. Consequently, installation of the retention ring 42 in the proper predetermined orientation relative to the carrier 30 and the blade track 32 requires each of the tabs 42T to be matched with an appropriately-sized slot 20S. As such, the differently-sized tabs 42T direct installation of the retention ring 42 in the predetermined orientation as discussed above.

In the illustrative embodiment, when the tabs 42T of the retention ring 42 are received by the corresponding slots 20S of the case 20 during operation of the turbine assembly 18, the ring 42 is constrained against rotation about the central axis 26 as suggested by FIG. 4. As such, the tabs 42T are provided to constrain the retention ring 42 against rotation about the axis 26 as discussed above.

In the illustrative embodiment, when the tabs 42T of the retention ring 42 are received by the corresponding slots 20S of the case 20 during operation of the turbine assembly 18, a center 42C of the ring 42 lies on the central axis 26 as shown in FIG. 4. As such, the tabs 42T are provided to center the ring 42 on the axis 26 as discussed above when thermal expansion and contraction occurs during operation of the assembly 18.

Figure 5:
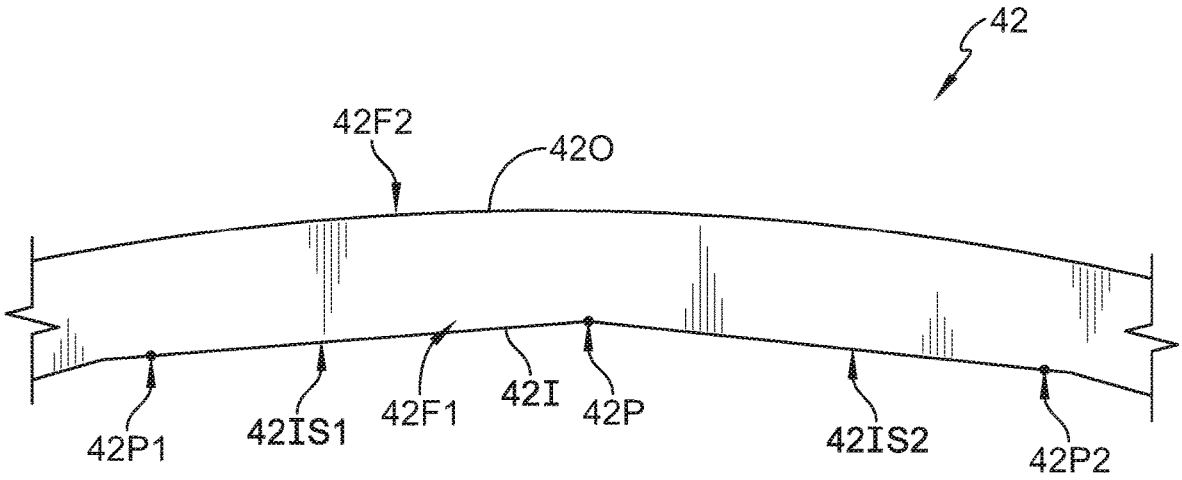
FIG. 5 is a detail view of a portion of the retention ring of FIG. 4 showing two circumferentially adjacent surface segments of the radially-inner surface.

Referring now to FIG. 5, two circumferentially adjacent surface segments 42IS1, 42IS2 defined by the inner flange portion 42F2 of the retention ring 42 are shown in greater detail. In the illustrative embodiment, a radial distance 42D measured between a point 42P at which the surface segments 42IS1, 42IS2 intersect and the central axis 26 is greater than respective radial distances 42D1, 42D2 measured between respective points 42P1, 42P2 located on the segments 42IS1, 42IS2 and the axis 26.

Referring now to FIG. 6, one of the tabs 42T of the illustrative retention ring 42 is shown in greater detail. The tab 42T illustratively has a rectangular shape. In other embodiments, however, the tab 42T may take the shape of other suitable geometric forms.

A gas turbine engine (e.g., the engine 10) may typically include alternating stages of static vanes (e.g., the vane assembly 44) and rotating blades (e.g., the wheel assembly 22) in the compressor (e.g., the compressor 14) and turbine (e.g., the turbine 18) sections. The rotating blades may impart mechanical energy to the flowpath gasses in the compressor section, and they may extract mechanical energy from the flowpath gasses (e.g., the gasses passed along the gas path GP) in the turbine section. In both the compressor and the turbine, the blades may be fitted to a rotating disc or drum.

For designs in which a shroud is not integral to the blade (e.g., the blades 28), the tips of the blades may move past a static blade track (e.g., the blade track 32) or seal segments. The seal segments may be positioned just radially outboard of the rotating blades. The degree of clearance (e.g., the predetermined clearance C) between the blade tips and the seal segments may have a substantial impact on the aerodynamic efficiency of the engine. Without seal segments radially outboard of the blades, air might be free to migrate over the blade tips from the pressure sides of the blades to the suction sides of the blades.

During operation, a seal segment (e.g., the blade track segment 34) may be loaded radially inward (e.g., inward in the radial direction R) and rearward (e.g., aftward along the central axis 26) by the pressurized cavity (e.g., the cavity 36) between the segment and the carrier (e.g., the carrier 30). The seal segment may be retained radially by the carrier. In order to properly locate the seal segment in the engine (e.g., along the axis 26), a feature may be desired to provide an axial stop for the seal segment. The present disclosure may utilize a retention ring (e.g., the retention ring 42) to provide that feature. The retention ring may be fully continuous in the circumferential direction (e.g., the full-hoop construction of the ring 42).

In order to mitigate thermally driven stresses and accommodate thermal expansion and contraction during operation, static components in the turbine (e.g., the carrier 30 and the blade track 32) may often be segmented circumferentially such that the components form a complete annular structure when all of the segments are assembled. The circumferentially continuous nature of the retention ring may provide an improvement in structural stiffness and deflections, as well as reduced leak paths compared to a segmented component. However, management of the thermal expansion and contraction of the full-hoop ring may require care to be taken, as the response to temperature changes and gradients of the full-hoop ring may differ significantly from the segmented components the ring interfaces with.

The cavity radially outboard of the seal segments may be pressurized with cooling air supplied by discharge air from the compressor which bypasses the combustor. In order to prevent ingress of high temperature, gas path air into the cavity radially outboard of the seal segments, and to minimize leakage of the compressor discharge air outside of the cavity, it may be desirable to seal the interfaces between the segment and surrounding components. The present disclosure may utilize chordal seals to accomplish this end. A chordal seal (e.g., the seal feature 48) may be used at the interface (e.g., location L1) between the nozzle guide vane (e.g., the vane 46) and the carrier. Additionally, a chordal seal (e.g., the seal S established between the blade track segments 34 and the retention ring 42) may be used at the interface between the seal segments and the retention ring.

A chordal seal may generally be a metal-to-metal seal comprised of a straight feature with a crowned (e.g., the crowned profile CP of the inner flange portion 42F1) or similar profile which allows for the formation of a line or face seal between the chordal seal feature and the component it interfaces with. The crowned profile of the seal and the straight, rather than radial, shape of the seal may allow the seal and its interfacing component to experience some misalignment with respect to each other while still maintaining an effective seal. The degree of misalignment may vary due to variations in structural and thermal deflections throughout an engine's operating cycles.

A chordal seal may often be part of a segmented component since the straight sections of the seal may be more straightforward to manufacture on a segmented component than on a full-hoop component. The present disclosure, however, contemplates a chordal seal feature (e.g., the surface segments 42IS) that is included in the fully continuous axial retention ring. The radially inboard surface of the ring (e.g., the radially-inner surface 42I) may be a polygon (e.g., defining the polygonal shape P) rather than a circle. The radially inboard surface may form part of the chordal seal feature corresponding to each face of the polygon. The number of flat surfaces (and corresponding chordal seal sections) may be equal to the number of seal segments that the retention ring interfaces with. The seal may reduce leakage into the gas path from the cavity radially outboard of the seal segment.

The chordal seal features on the retention ring may mate with the coated and machined aft surface of the segment aft hanger (e.g., the surface 50S of the aft hanger 40B). That surface may be coated and machined because the segment may be made of ceramic matrix composite (CMC) material. The axial retention ring may be metallic, and it may be simpler to form the chordal seal feature on the ring rather than on the CMC segment. The coating (e.g., the coating 50) may be applied and machined to form a surface with a low roughness compared to the as-formed CMC material, which may have an undesirable surface roughness for sealing. The concepts of the present disclosure are not specifically limited to applications with a CMC segment and can be more broadly applied to a seal segment assembly regardless of material system.

In order for the chordal seal features of the retention ring to function effectively, it may be desirable to preserve their orientation with respect to the corresponding seal segments. To do so, the retention ring may include three anti-rotation tabs (e.g., the tabs 42T) which protrude from the ring's outer diameter and interface with three corresponding slots (e.g., the slots 20S) in the case (e.g., the case 20). Each of the three tabs (and their corresponding slots in the case) may have a different width to ensure that the ring is installed in its proper orientation.

It may be desirable to align the center of the ring (e.g., the center 42C) with the engine axis (e.g., the central axis 26) so that the ring functions properly. The three tabs may be equally spaced circumferentially so that the ring center remains aligned with the engine axis when accounting for relative thermal expansion and contraction. Thus, the tabs may perform several functions: constraining the ring against rotation and keeping the ring centered about the engine axis.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A turbine assembly comprising a carrier coupled to a case, a blade track cooperating with the carrier to define a cavity configured to receive pressurized gasses, the blade track extending around blades of a turbine wheel assembly to block gasses passed along a gas path from moving over the blades without causing the blades to rotate during operation of the turbine assembly, the blade track including a plurality of blade track segments arranged circumferentially adjacent to one another about a central axis to form a ring, each blade track segment having a runner and an attachment feature coupled to the carrier, and a retention ring coupled to the carrier and the blade track to retain the blade track segments at predetermined locations along the central axis during operation of the turbine assembly, the retention ring including a radially-inner surface having a plurality of generally planar surface segments that cooperate to define a polygonal shape of the inner surface, wherein each one of the surface segments interfaces with the attachment feature of one of the blade track segments such that the radially-inner surface provides a seal to resist leakage of the pressurized gasses provided to the cavity into the gas path during operation of the turbine assembly, wherein a first point at which two circumferentially adjacent surface segments of the radially-inner surface intersect is spaced from the central axis by a first radial distance, a second point located on one of the two circumferentially adjacent surface segments is spaced from the central axis by a second radial distance less than the first radial distance, and a third point located on the other of the two circumferentially adjacent surface segments is spaced from the central axis by a third radial distance less than the first radial distance.

2. The turbine assembly of claim 1, wherein the retention ring includes an inner flange portion defining the radially-inner surface thereof that has a slightly crowned profile and the inner flange portion is configured to align with and engage the attachment feature of each one of the blade track segments to establish the seal during operation of the turbine assembly.

3. The turbine assembly of claim 1, wherein the retention ring has a full-hoop construction.

4. The turbine assembly of claim 3, wherein the number of blade track segments of the blade track is substantially equal to the number of surface segments of the radially-inner surface of the retention ring.

5. The turbine assembly of claim 1, wherein the attachment feature of each blade track segment includes a forward hanger and an aft hanger located aft of the forward hanger along the central axis, and each one of the surface segments of the radially-inner surface interfaces directly with the aft hanger of one of the blade track segments during operation of the turbine assembly to establish the seal.

6. The turbine assembly of claim 5, wherein the blade track has a ceramic matrix composite material construction, a coating is applied to the aft hanger of each blade track segment, and each one of the surface segments is engaged with the coating applied to the aft hanger of one of the blade track segments during operation of the turbine assembly.

7. The turbine assembly of claim 1, wherein the retention ring includes a plurality of tabs extending outwardly from a radially-outer surface thereof opposite the radially-inner surface, the tabs are received by corresponding slots formed in the case such that the retention ring is installed in a predetermined orientation relative to the carrier and the blade track, constrained against rotation about the central axis, and positioned so that a center of the retention ring lies on the central axis during operation of the turbine assembly.

8. The turbine assembly of claim 7, wherein the plurality of tabs includes three tabs.

9. The turbine assembly of claim 7, wherein at least two of the plurality of tabs have widths different from one another.

10. A turbine shroud comprising a carrier formed from metallic materials, a blade track coupled to the carrier and formed from ceramic matrix composite materials, the blade track including a plurality of blade track segments, and a retention ring coupled to the carrier and the blade track to retain the blade track segments at predetermined locations along a central axis, the retention ring including a plurality of surface segments that interface with the blade track segments to provide a seal, wherein the surface segments cooperate to define a polygonal shape of at least part of the retention ring, wherein a first point at which two circumferentially adjacent surface segments of the retention ring intersect is spaced from the central axis by a first radial distance, a second point located on one of the two circumferentially adjacent surface segments is spaced from the central axis by a second radial distance less than the first radial distance, and a third point located on the other of the two circumferentially adjacent surface segments is spaced from the central axis by a third radial distance less than the first radial distance.

11. A turbine shroud comprising a carrier formed from metallic materials, a blade track coupled to the carrier and formed from ceramic matrix composite materials, the blade track including a plurality of blade track segments, and a retention ring coupled to the carrier and the blade track to retain the blade track segments at predetermined locations along a central axis, the retention ring including a plurality of surface segments that interface with the blade track segments to provide a seal, wherein the surface segments cooperate to define a polygonal shape of at least part of the retention ring, wherein each blade track segment includes a forward hanger and an aft hanger located aft of the forward hanger along the central axis, and each one of the surface segments interfaces directly with the aft hanger of one of the blade track segments during operation of the turbine assembly to establish the seal.

12. The turbine shroud of claim 10, wherein the retention ring has a full-hoop construction.

13. The turbine shroud of claim 10, wherein a portion of the retention ring has a slightly crowned profile and the portion is configured to align with and engage each one of the blade track segments to establish the seal during operation of the turbine assembly.

14. A turbine shroud comprising a carrier formed from metallic materials, a blade track coupled to the carrier and formed from ceramic matrix composite materials, the blade track including a plurality of blade track segments, and a retention ring coupled to the carrier and the blade track to retain the blade track segments at predetermined locations along a central axis, the retention ring including a plurality of surface segments that interface with the blade track segments to provide a seal, wherein the surface segments cooperate to define a polygonal shape of at least part of the retention ring, wherein the retention ring includes a plurality of tabs extending outwardly from an outer surface thereof, and the tabs are received by corresponding slots formed in a case such that the retention ring is installed in a predetermined orientation relative to the carrier and the blade track during operation of the turbine assembly.

15. The turbine shroud of claim 14, wherein the tabs are sized to be received by the slots such that a center of the retention ring lies on the central axis and the retention ring is constrained against rotation about the central axis during operation of the turbine assembly.

16. The turbine shroud of claim 14, wherein the plurality of tabs includes three tabs circumferentially spaced from one another about the central axis by about 120 degrees.

17. The turbine shroud of claim 14, wherein the plurality of tabs are non-equidistantly spaced from one another about the central axis.

18. The turbine shroud of claim 14, wherein at least two of the plurality of tabs have widths different from one another.

* * * * *